US006715987B2

(12) United States Patent
Rossi et al.

(10) Patent No.: US 6,715,987 B2
(45) Date of Patent: Apr. 6, 2004

(54) STATOR BLADING OF RETURN CHANNELS FOR TWO-DIMENSIONAL CENTRIFUGAL STAGES OF A MULTI-STAGE CENTRIFUGAL COMPRESSOR WITH IMPROVED EFFICIENCY

(75) Inventors: Eugenio Rossi, Viareggio (IT); Antonio Pelagotti, Sesto Fiorentino (IT)

(73) Assignee: Nuovo Pignone Holding S.p.A., Florence (IT)

( * ) Notice: Subject to any disclaimer, the term of this patent is extended or adjusted under 35 U.S.C. 154(b) by 0 days.

(21) Appl. No.: 10/270,166

(22) Filed: Oct. 15, 2002

(65) Prior Publication Data

US 2003/0077177 A1 Apr. 24, 2003

(30) Foreign Application Priority Data

Oct. 18, 2001 (IT) ..... MI2001A2169

(51) Int. Cl.[7] ..... F01D 29/44
(52) U.S. Cl. ..... 415/191; 415/199.2; 415/211.2
(58) Field of Search ..... 415/191, 211.2, 415/199.2; 416/243, DIG. 2, DIG. 5

(56) References Cited

U.S. PATENT DOCUMENTS 4,877,373 A * 10/1989 Bandukwalla ..... 415/208.4
6,325,597 B1 * 12/2001 Kim et al. ..... 416/238
6,371,724 B2 * 4/2002 Nagaoka et al. ..... 415/208.3
6,398,489 B1 * 6/2002 Burdgick et al. ..... 415/115

* cited by examiner

*Primary Examiner*—Ninh H. Nguyen
(74) *Attorney, Agent, or Firm*—Nixon & Vanderhye

(57) ABSTRACT

Stator blading (10) of return channels for two-dimensional centrifugal stages of a multi-stage centrifugal compressor with improved efficiency, of the type comprising a plurality of blades (20) disposed circumferentially equally spaced on a ring (12) which surrounds a rotor of the compressor, these blades (20) each having a cross-section in the shape of a half-moon formed by a concave area (21) and a convex area (22), these concave (21) and convex (22) areas being connected to one another such as to determine a trailing edge (24) and a leading edge (23) on an inner radius (R); the profile of the concave area (21) of each blade (20) is produced by connecting to one another points which have particular Cartesian co-ordinates relative to a system of axes which are at right-angles to one another, of x-co-ordinates (X) and y-co-ordinates (Y) with an origin (O) located on the axis of rotation.

7 Claims, 2 Drawing Sheets

STATOR BLADING OF RETURN CHANNELS FOR TWO-DIMENSIONAL CENTRIFUGAL STAGES OF A MULTI-STAGE CENTRIFUGAL COMPRESSOR WITH IMPROVED EFFICIENCY

The present invention relates to stator blading of return channels for two-dimensional centrifugal stages of a multi-stage centrifugal compressor with improved efficiency.

A centrifugal compressor is a machine into which there is admitted a compressible fluid, which is then discharged at a pressure greater than its own intake pressure.

Centrifugal compressors are formed by a cylindrical body or case which is closed at its own ends and contains the operative units of the machine.

Centrifugal compressors can include one or more stages, and can be used for medium and/or high pressures, but hereinafter in the present description reference is made to multi-stage centrifugal compressors.

Non-exhaustive examples of the possible uses of such centrifugal compressors are: re-injection of gas, re-compression of gas, use of the compressor in association with plants for supply of gaseous fuel in machines for generation of power, in refineries, in plants for synthesis of methanol and ammonia, and in high-pressure or liquid natural gas lines.

The basic elements which constitute a multi-stage centrifugal compressor are a rotor which rotates around the axis of the machine, and a series of diffusers or stators with return channels between the various stages, which are integral with a case.

The rotor consists of a series of discs with blading fitted onto a single shaft.

In the rotor, the fluid, which is collected from the central section of the rotor, is forced by this rotary blading and undergoes an increase in speed and therefore in dynamic pressure. The static pressure is also increased owing to the divergent profile of the spaces between the blades of the blading. The rotor therefore gives rise to an increase in the total pressure and an increase in the speed.

Each disc of the rotor is followed by a diffuser, which is also provided with blading.

In the diffuser, owing to the divergent shape of the ducts between one blade and another, the fluid undergoes a reduction of speed. This leads to the loss of part of the dynamic pressure gained in the preceding disc of the rotor, and to an increase in the static pressure, caused by the transformation of kinetic energy into pressure energy.

With each diffuser there is associated a return channel, which conveys the fluid to the successive disc of the rotor. More specifically, the flow of the fluid is returned in the axial direction, thus eliminating the tangential speed imparted by the rotor disc of the preceding stage.

The assembly of a disc of the rotor and of a diffuser, with the corresponding return channel, constitutes a stage, which is separated from the adjacent stages by annular diaphragms.

In compressors of this type there is however the difficulty of conveying the fluid satisfactorily from the output of one stage to the intake of the subsequent one, such as to limit the losses.

In general the return channels are characterised by geometries of a simple type. Their profile is frequently constituted by arcs of a circle which are regularly connected.

The aerodynamic design of these components is carried out using criteria which are substantially empirical, and in general design methods which are aimed specifically at reduction of the losses are not used.

However the return channels give rise to very complex aerodynamic phenomena, which could potentially introduce significant losses of efficiency.

A detailed analysis of the flow in the return channels can be carried out both with experimental means and numerical methods.

This shows that these channels are frequently affected by effects of separation of the flow, which detract from the overall efficiency of the compressor.

The object of the present invention is to eliminate the above-described disadvantages and in particular to provide stator blading of return channels for two-dimensional centrifugal stages of a multi-stage centrifugal compressor with improved efficiency, which makes it possible to increase the overall performance of the compressor.

Another object of the present invention is to provide stator blading of return channels for two-dimensional centrifugal stages of a multi-stage centrifugal compressor with improved efficiency, which is particularly reliable, simple, functional and has relatively low costs.

These objects and others according to the present invention are achieved by providing stator blading of return channels for two-dimensional centrifugal stages of a multi-stage centrifugal compressor with improved efficiency, as described in claim 1.

Further characteristics are indicated in the subsequent claims.

Stator blading of return channels for two-dimensional centrifugal stages of a multi-stage centrifugal compressor with improved efficiency has the advantage of comprising a significant reduction in the areas of separation in the vicinity of the output cross-section of the blades of this blading. This therefore provides improved polytropic stage efficiency.

The characteristics and advantages of stator blading of return channels for two-dimensional centrifugal stages of a multi-stage centrifugal compressor with improved efficiency according to the present invention will become more apparent from the following description provided by way of non-limiting example with reference to the attached schematic drawings, in which.

The figures show stator blading of return channels for two-dimensional centrifugal stages of a multi-stage centrifugal compressor indicated as 10 as a whole.

Figure 1:
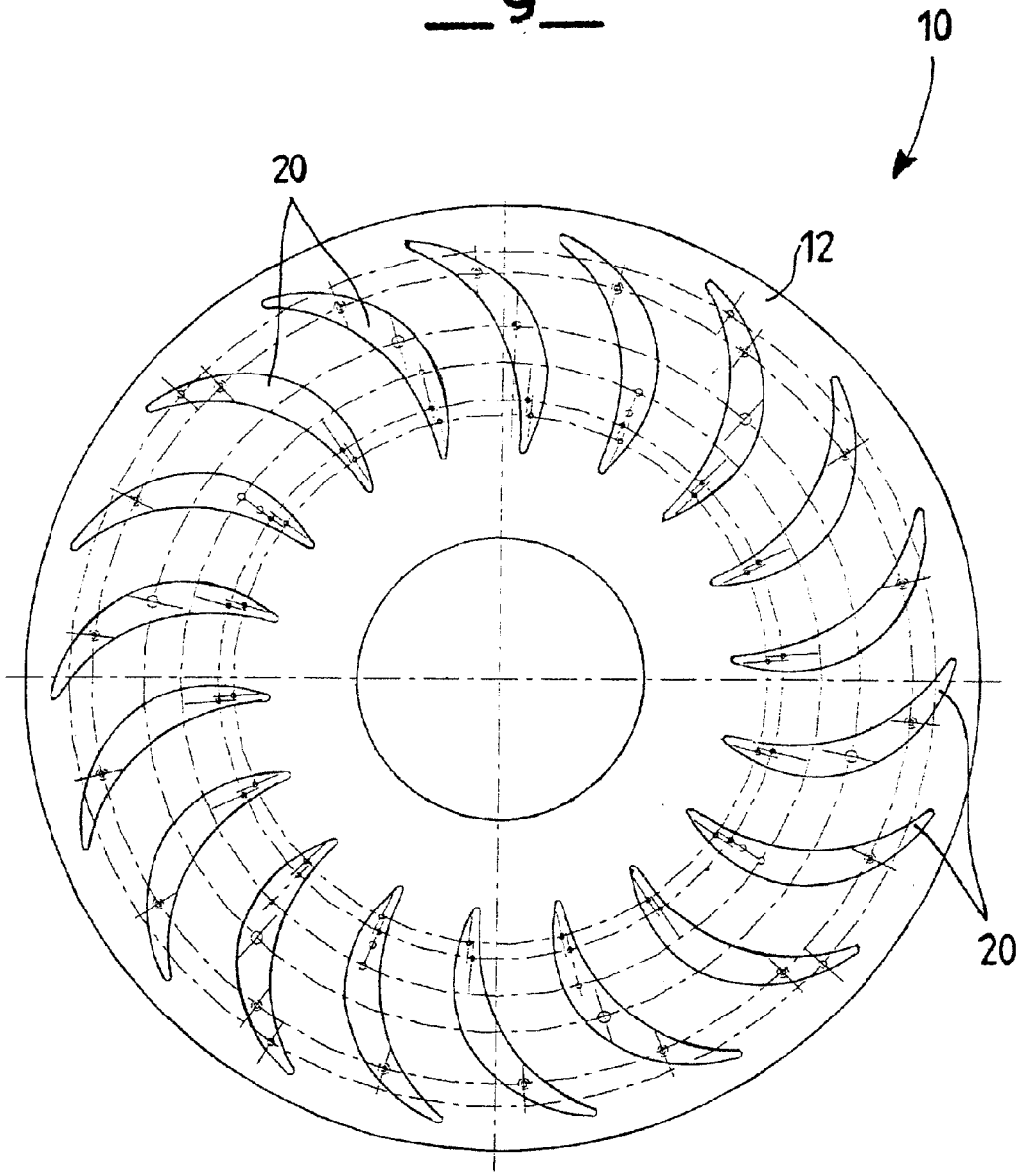
FIG. 1 is a front view, according to the direction of the flow, of a stator blading of return channels for a two-dimensional centrifugal stage of a multi-stage centrifugal compressor, according to the teaching of the present invention.

In the non-limiting example in FIG. 1, the blading 10 comprises eighteen blades 20, disposed equally spaced around a circumference on a ring 12.

The centre of the ring 12 coincides with the axis of rotation of the rotor of the centrifugal compressor.

The blades 20 are elements with cylindrical development, with generatrices which are parallel to the axis of rotation.

Figure 2:
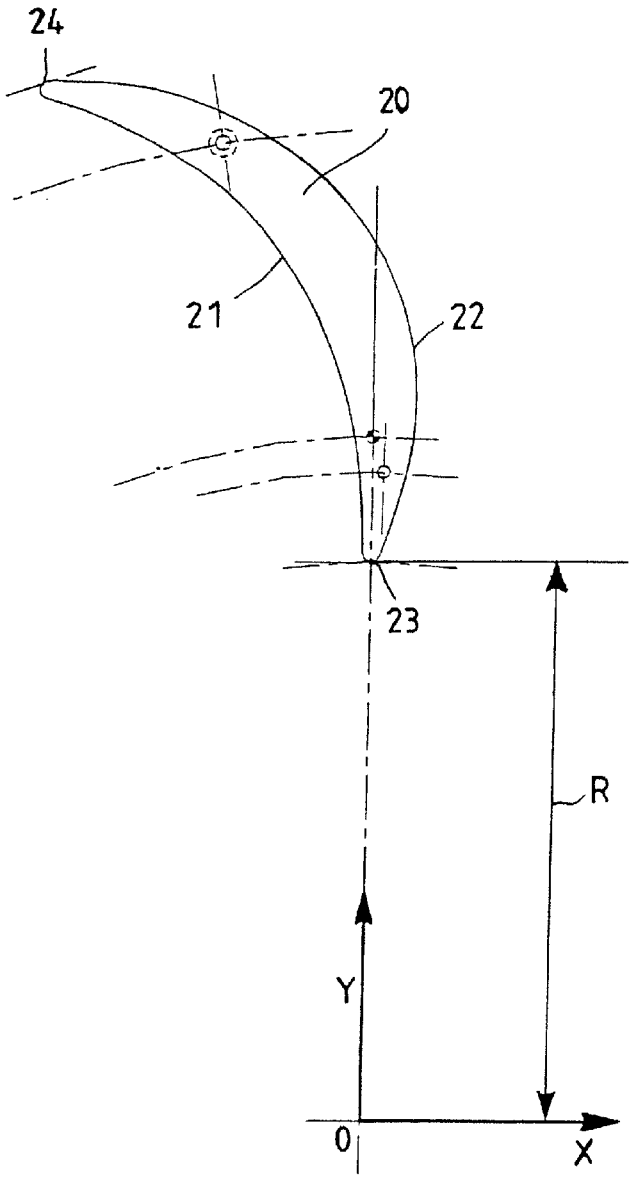
FIG. 2 is a front view, according to the direction of flow, which shows a stator blade for return channels, used in the blading in FIG. 1.
Figure 3:
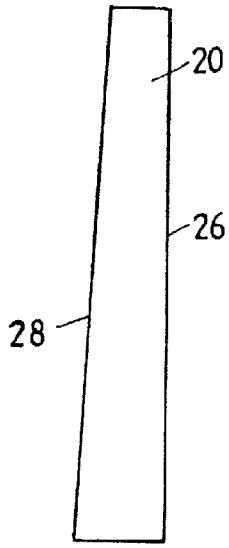
FIG. 3 is an elevated lateral view of the blading in FIG. 2.

FIGS. 2 and 3 show a cross-section of a single blade 20, and also indicate a system of Cartesian axes at right-angles with an x-co-ordinate X, a y-co-ordinate Y and an origin O, located on the axis of rotation.

The blade 20 is in the shape of a half-moon, with a concave area 21 and a convex area 22. More particularly, the concave area 21 corresponds to a pressure area, and the convex area 22 corresponds to a low-pressure area.

In addition, these areas 21 and 22 are connected such as to form two edges of the half-moon, and specifically a leading edge 23 and a trailing edge 24.

The blade 20 is secured such that the concave area 21 in the vicinity of the leading edge 23 is almost parallel to the flow.

As shown in FIG. 3, the blade 20 has a flat surface 26 on one side, and in the opposite position a surface 28 which is slightly inclined, such that the thickness decreases as the radius increases, in accordance with the known art.

In this flat surface 26 there are provided holes for positioning and elements for securing, such as pins and tie rods, between the blades 20 and the ring 12.

With reference to the system of Cartesian axes at right-angles X and Y in FIG. 2, a geometric form is now specified, and consequently a particular orientation, of an outer profile of the concave area 21 and of the convex area 22 of a blade 20 according to the present invention.

The concave area 21 is advantageously provided by connecting to one another for example the following discrete series of twenty construction points, expressed in the form of Cartesian co-ordinates X and Y of the reference in FIG. 2, wherein R also indicates the inner radius on which the leading edge 23 is located:

| | |
|---|---|
| X = 0.053 × R | Y = 1.924 × R; |
| X = 0.112 × R | Y = 1.880 × R; |
| X = 0.148 × R | Y = 1.848 × R; |
| X = 0.193 × R | Y = 1.803 × R; |
| X = 0.233 × R | Y = 1.757 × R; |
| X = 0.268 × R | Y = 1.710 × R; |
| X = 0.297 × R | Y = 1.665 × R; |
| X = 0.320 × R | Y = 1.621 × R; |
| X = 0.338 × R | Y = 1.574 × R; |
| X = 0.361 × R | Y = 1.503 × R; |
| X = 0.373 × R | Y = 1.453 × R; |
| X = 0.385 × R | Y = 1.388 × R; |
| X = 0.388 × R | Y = 1.321 × R; |
| X = 0.386 × R | Y = 1.252 × R; |
| X = 0.381 × R | Y = 1.184 × R; |
| X = 0.373 × R | Y = 1.134 × R; |
| X = 0.362 × R | Y = 1.091 × R; |
| X = 0.348 × R | Y = 1.045 × R; |
| X = 0.337 × R | Y = 1.006 × R; |
| X = 0.324 × R | Y = 0.964 × R. |

The convex area 22 is advantageously provided by connecting to one another for example the following discrete series of twenty construction points, expressed in the form of Cartesian co-ordinates X and Y of the reference in FIG. 2, wherein R again indicates the radius on which the leading edge 23 is located:

| | |
|---|---|
| X = 0.069 × R | Y = 1.952 × R; |
| X = 0.154 × R | Y = 1.919 × R; |
| X = 0.190 × R | Y = 1.902 × R; |
| X = 0.236 × R | Y = 1.877 × R; |
| X = 0.280 × R | Y = 1.847 × R; |
| X = 0.328 × R | Y = 1.806 × R; |
| X = 0.384 × R | Y = 1.750 × R; |
| X = 0.441 × R | Y = 1.678 × R; |
| X = 0.485 × R | Y = 1.602 × R; |
| X = 0.512 × R | Y = 1.532 × R; |
| X = 0.530 × R | Y = 1.448 × R; |
| X = 0.535 × R | Y = 1.368 × R; |
| X = 0.528 × R | Y = 1.285 × R; |

-continued

| | |
|---|---|
| X = 0.518 × R | Y = 1.237 × R; |
| X = 0.498 × R | Y = 1.176 × R; |
| X = 0.477 × R | Y = 1.132 × R; |
| X = 0.448 × R | Y = 1.081 × R; |
| X = 0.419 × R | Y = 1.038 × R; |
| X = 0.373 × R | Y = 0.975 × R; |
| X = 0.353 × R | Y = 0.949 × R. |

The concave area 21 and the convex area 22 provided by connecting the preceding twenty construction points constitute by way of example a preferred but non-limiting embodiment.

In practice, in order to obtain stator blading of return channels for two-dimensional centrifugal stages of a multi-stage centrifugal compressor with improved efficiency according to the present invention, the individual blades 20 must be produced by connecting to one another the said points of construction of the areas 21 and 22, always taking into consideration the conventional processing tolerances.

More particularly, each said point of construction must be considered as the centre of a dispersion circle with a radius of 0.6 mm.

By this means, the present invention incorporates the blade profiles 20 which are obtained by connecting a series of points, each of which lies within the circle or circumference which has a radius of 0.6 mm and centre at the said points of construction.

This therefore provides a family of profiles for the concave area 21 and for the convex area 22 which are centred at the said points of construction, and with a maximum displacement from the latter of 0.6 mm.

In particular, in the case of blades 20 with an inner radius equal to 155 mm, on which the leading edges 23 of the blades 20 themselves are located, advantageous results are obtained with the following points of construction for each concave area 21:

| | |
|---|---|
| X = 8.28 mm | Y = 298.26 mm; |
| X = 17.39 mm | Y = 291.34 mm; |
| X = 22.97 mm | Y = 286.41 mm; |
| X = 29.93 mm | Y = 279.42 mm; |
| X = 36.08 mm | Y = 272.35 mm; |
| X = 41.6 mm | Y = 265.07 mm; |
| X = 46.09 mm | Y = 258.03 mm; |
| X = 49.58 mm | Y = 251.21 mm; |
| X = 52.46 mm | Y = 244.01 mm; |
| X = 55.93 mm | Y = 232.92 mm; |
| X = 57.88 mm | Y = 225.24 mm; |
| X = 59.61 mm | Y = 215.11 mm; |
| X = 60.14 mm | Y = 204.75 mm; |
| X = 59.83 mm | Y = 194 mm; |
| X = 59.06 mm | Y = 183.58 mm; |
| X = 57.79 mm | Y = 175.79 mm; |
| X = 56.07 mm | Y = 169.14 mm; |
| X = 53.96 mm | Y = 161.92 mm; |
| X = 52.18 mm | Y = 155.9 mm; |
| X = 50.22 mm | Y = 149.42 mm. |

In the same case of an inner radius R equal to 155 mm, advantageous results are obtained with the following points of construction for each convex area 22:

| | |
|---|---|
| X = 10.71 mm | Y = 302.58 mm; |
| X = 23.85 mm | Y = 297.38 mm; |

-continued

| | |
|---|---|
| X = 29.45 mm | Y = 294.88 mm; |
| X = 36.65 mm | Y = 290.91 mm; |
| X = 43.37 mm | Y = 286.23 mm; |
| X = 50.91 mm | Y = 279.86 mm; |
| X = 59.49 mm | Y = 271.28 mm; |
| X = 68.3 mm | Y = 260.13 mm; |
| X = 75.1 mm | Y = 248.3 mm; |
| X = 79.29 mm | Y = 237.47 mm; |
| X = 82.16 mm | Y = 224.41 mm; |
| X = 82.98 mm | Y = 212.03 mm; |
| X = 81.91 mm | Y = 199.25 mm; |
| X = 80.28 mm | Y = 191.66 mm; |
| X = 77.15 mm | Y = 182.32 mm; |
| X = 74.01 mm | Y = 175.46 mm; |
| X = 69.48 mm | Y = 167.57 mm; |
| X = 65 mm | Y = 160.86 mm; |
| X = 57.77 mm | Y = 151.07 mm; |
| X = 54.66 mm | Y = 147.16 mm. |

The description provided makes apparent the characteristics of the stator blading of return channels for two-dimensional centrifugal stages of a multi-stage centrifugal compressor with improved efficiency which is the subject of the present invention, and also makes apparent the corresponding advantages, amongst which in particular should be noted the increase in the polytropic stage efficiency.

This increase is equal to approximately two percentile points compared with blading produced according to the known art.

In addition, stator blading of return channels for two-dimensional centrifugal stages of a multi-stage centrifugal compressor produced according to the geometry described in the present invention comprises a significant reduction in the area of separation in the vicinity of the output cross-section of the blades of this blading.

This is also shown by displaying the flow obtained by means of numerical calculation codes based on the integration of the three-dimensional Navier-Stokes equations.

Finally, it is apparent that the stator blading of return channels for two-dimensional centrifugal stages of a multi-stage centrifugal compressor with improved efficiency thus designed can be subjected to numerous modifications and variants, all of which come within the scope of the invention; in addition all the details can be replaced by technically equivalent elements.

In practice any materials, forms and dimensions can be used according to the technical requirements.

The scope of protection of the invention is thus delimited by the attached claims.

What is claimed is:

1. Stator blading (10) of return channels for two-dimensional centrifugal stages of a multi-stage centrifugal compressor with improved efficiency, of the type comprising a plurality of blades (20) disposed circumferentially equally spaced on a ring (12) which surrounds a rotor of the compressor, the said blades (20) each having a cross-section in the shape of a half-moon formed by a concave area (21) and a convex area (22), the said concave (21) and convex (22) areas being connected to one another such as to determine a trailing edge (24) and a leading edge (23) on an inner radius (R) measured relative to an axis of rotation of the rotor of the compressor, characterised in that the profile of the said concave area (21) of each blade (20) is produced by connecting to one another points which are each in circles or on circumferences with a radius of 0.6 mm and centres with the following Cartesian co-ordinates relative to a system of axes which are at right-angles to one another, of x-co-ordinates (X) and y-co-ordinates (Y) with an origin (O) located on the axis of rotation:

| | |
|---|---|
| X = 0.053 × R | Y = 1.924 × R; |
| X = 0.112 × R | Y = 1.880 × R; |
| X = 0.148 × R | Y = 1.848 × R; |
| X = 0.193 × R | Y = 1.803 × R; |
| X = 0.233 × R | Y = 1.757 × R; |
| X = 0.268 × R | Y = 1.710 × R; |
| X = 0.297 × R | Y = 1.665 × R; |
| X = 0.320 × R | Y = 1.621 × R; |
| X = 0.338 × R | Y = 1.574 × R; |
| X = 0.361 × R | Y = 1.503 × R; |
| X = 0.373 × R | Y = 1.453 × R; |
| X = 0.385 × R | Y = 1.388 × R; |
| X = 0.388 × R | Y = 1.321 × R; |
| X = 0.386 × R | Y = 1.252 × R; |
| X = 0.381 × R | Y = 1.184 × R; |
| X = 0.373 × R | Y = 1.134 × R; |
| X = 0.362 × R | Y = 1.091 × R; |
| X = 0.348 × R | Y = 1.045 × R; |
| X = 0.337 × R | Y = 1.006 × R; |
| X = 0.324 × R | Y = 0.964 × R. |

2. Stator blading (10) according to claim 1, characterised in that the profile of the said convex area (22) of each blade (20) is produced by connecting to one another points which are each in circles or on circumferences with a radius of 0.6 mm and centres with the following Cartesian co-ordinates relative to the said system of axes which are at right-angles to one another:

| | |
|---|---|
| X = 0.069 × R | Y = 1.952 × R; |
| X = 0.154 × R | Y = 1.919 × R; |
| X = 0.190 × R | Y = 1.902 × R; |
| X = 0.236 × R | Y = 1.877 × R; |
| X = 0.280 × R | Y = 1.847 × R; |
| X = 0.328 × R | Y = 1.806 × R; |
| X = 0.384 × R | Y = 1.750 × R; |
| X = 0.441 × R | Y = 1.678 × R; |
| X = 0.485 × R | Y = 1.602 × R; |
| X = 0.512 × R | Y = 1.532 × R; |
| X = 0.530 × R | Y = 1.448 × R; |
| X = 0.535 × R | Y = 1.368 × R; |
| X = 0.528 × R | Y = 1.285 × R; |
| X = 0.518 × R | Y = 1.237 × R; |
| X = 0.498 × R | Y = 1.176 × R; |
| X = 0.477 × R | Y = 1.132 × R; |
| X = 0.448 × R | Y = 1.081 × R; |
| X = 0.419 × R | Y = 1.038 × R; |
| X = 0.373 × R | Y = 0.975 × R; |
| X = 0.353 × R | Y = 0.949 × R. |

3. Stator blading (10) according to claim 1, characterised in that the profile of the said concave area (21) of each blade (20) is produced by connecting to one another points of construction with the following Cartesian co-ordinates relative to the said system of axes at right-angles to one another:

| | |
|---|---|
| X = 8.28 mm | Y = 298.26 mm; |
| X = 17.39 mm | Y = 291.34 mm; |
| X = 22.97 mm | Y = 286.41 mm; |
| X = 29.93 mm | Y = 279.42 mm; |
| X = 36.08 mm | Y = 272.35 mm; |
| X = 41.6 mm | Y = 265.07 mm; |
| X = 46.09 mm | Y = 258.03 mm; |
| X = 49.58 mm | Y = 251.21 mm; |
| X = 52.46 mm | Y = 244.01 mm; |
| X = 55.93 mm | Y = 232.92 mm; |
| X = 57.88 mm | Y = 225.24 mm; |

-continued

| | |
|---|---|
| X = 59.61 mm | Y = 215.11 mm; |
| X = 60.14 mm | Y = 204.75 mm; |
| X = 59.83 mm | Y = 194 mm; |
| X = 59.06 mm | Y = 183.58 mm; |
| X = 57.79 mm | Y = 175.79 mm; |
| X = 56.07 mm | Y = 169.14 mm; |
| X = 53.96 mm | Y = 161.92 mm; |
| X = 52.18 mm | Y = 155.9 mm; |
| X = 50.22 mm | Y = 149.42 mm. |

4. Stator blading (10) according to claim 2, characterised in that the profile of the said convex area (22) of each blade (20) is produced by connecting to one another points of construction with the following Cartesian co-ordinates relative to the said system of axes at right-angles to one another:

| | |
|---|---|
| X = 10.71 mm | Y = 302.58 mm; |
| X = 23.85 mm | Y = 297.38 mm; |
| X = 29.45 mm | Y = 294.88 mm; |
| X = 36.65 mm | Y = 290.91 mm; |
| X = 43.37 mm | Y = 286.23 mm; |
| X = 50.91 mm | Y = 279.86 mm; |
| X = 59.49 mm | Y = 271.28 mm; |
| X = 68.3 mm | Y = 260.13 mm; |
| X = 75.1 mm | Y = 248.3 mm; |

-continued

| | |
|---|---|
| X = 79.29 mm | Y = 237.47 mm; |
| X = 82.16 mm | Y = 224.41 mm; |
| X = 82.98 mm | Y = 212.03 mm; |
| X = 81.91 mm | Y = 199.25 mm; |
| X = 80.28 mm | Y = 191.66 mm; |
| X = 77.15 mm | Y = 182.32 mm; |
| X = 74.01 mm | Y = 175.46 mm; |
| X = 69.48 mm | Y = 167.57 mm; |
| X = 65 mm | Y = 160.86 mm; |
| X = 57.77 mm | Y = 151.07 mm; |
| X = 54.66 mm | Y = 147.16 mm. |

5. Stator blading according to claim 1, characterised in that the there are eighteen of the said blades.

6. Stator blading according to claim 1, characterised in that each of the said blades has a flat surface on one side, and in the opposite position a slightly inclined surface, such that the thickness decreases as the radius increases, holes being provided in the said flat surface for positioning and securing elements.

7. Stator blading (10) according to claim 6, characterized in that the said positioning and securing elements comprise pins and tie rods.

* * * * *